US005713186A

United States Patent [19]

Bruhn

[11] Patent Number: 5,713,186

[45] Date of Patent: Feb. 3, 1998

[54] METHOD AND AN APPARATUS FOR PRODUCING BAG PACKS

[75] Inventor: Krister Bruhn, Seeheim-Jugenheim, Germany

[73] Assignee: Tetra Laval Holdings & Finance, S.A., Switzerland

[21] Appl. No.: 615,253

[22] PCT Filed: Sep. 29, 1994

[86] PCT No.: PCT/EP94/03256

§ 371 Date: Mar. 13, 1996

§ 102(e) Date: Mar. 13, 1996

[87] PCT Pub. No.: WO95/09771

PCT Pub. Date: Apr. 13, 1995

[30] Foreign Application Priority Data

Oct. 7, 1993 [CH] Switzerland ..... 9303278

[51] Int. Cl.[6] ..... B65B 9/00

[52] U.S. Cl. ..... 53/450; 53/450; 53/550; 53/551; 53/411; 156/244.11; 156/244.16

[58] Field of Search ..... 53/450, 451, 550, 53/551, 552, 553, 554, 555, 411, 432, 433, 140, 141; 156/244.11, 244.16

[56] References Cited

U.S. PATENT DOCUMENTS

| | | | |
|---|---|---|---|
| 3,467,565 | 9/1969 | Utz | 156/244.11 |
| 3,473,286 | 10/1969 | Henry | 53/411 |
| 3,733,381 | 5/1973 | Willette et al. | 156/244.16 |
| 4,214,934 | 7/1980 | Upmeier et al. | 156/244.11 |
| 4,384,442 | 5/1983 | Pendelton . | |
| 4,417,936 | 11/1983 | Gaffney | 156/244.16 |
| 4,424,260 | 1/1984 | Pupp | 53/551 |
| 4,522,675 | 6/1985 | Sharps, Jr. | 156/244.11 |
| 4,997,616 | 3/1991 | Dehennau et al. . | |
| 5,203,941 | 4/1993 | Spain et al. | 156/244.11 |
| 5,412,925 | 5/1995 | Tani et al. | 53/450 |

FOREIGN PATENT DOCUMENTS

| | | |
|---|---|---|
| 0392690 | 10/1990 | European Pat. Off. . |
| 1251602 | 12/1960 | France . |
| 670313 | 4/1952 | United Kingdom . |
| 1527065 | 10/1978 | United Kingdom . |

*Primary Examiner*—John Sipos

*Attorney, Agent, or Firm*—Killworth, Gottman, Eagan & Schaeff LLP

[57] ABSTRACT

The invention relates to a method and an apparatus for producing bag packs of plastic foil containing liquid or viscous contents. The production method, which may be divided into two parts, relates first to a method of producing the packaging material and secondly a method of using the packaging material for producing bag packs.

The packaging material is produced in that a hose of plastic foil is extruded and, while the material is still warm, flattened so that the insides of the plastic hose come into contact with one another and are brought to adhere to one another in a readily rupturable mechanical bond, so-called blocking. The flattened plastic hose is printed with the desired text or decor, whereafter the flattened hose (6) is divided into part webs (7) each of the desired width and decor.

The packaging webs (7) are converted into packages in that the mutually adhering layers (14, 15) are separated from one another, a filler pipe (16) is inserted between the webs whose edge zones are reunited with one another in a tight and mechanically durable union, for the formation of a tube (12) which is filled with the intended contents, whereafter the tube (12) is divided into individual package units (19) by repeated flattenings and sealings by means of specifically provided sealing devices (20) in zones at right angles to the longitudinal direction of the tube (12)

3 Claims, 1 Drawing Sheet

METHOD AND AN APPARATUS FOR PRODUCING BAG PACKS

TECHNICAL FIELD

The present invention relates to a method of producing bag packs of plastic foil and filled with liquid or viscous contents, and an apparatus for carrying the method into effect.

BACKGROUND ART

Although liquid-filled bag packs of plastic material are relatively difficult to transport and not easy to handle, there is a market for bag packs intended for the distribution of liquid or viscous goods such as milk, soups etc. The reason for this is that the bag packs are cheap and that they are considered to be environmentally friendly, since they require slightly less material than formed and configurationally stable packaging containers of the disposable type. Bag packs of plastic foil are generally produced in that a web of plastic foil is folded double, that the free edge zones of the double-folded web are united with one another for the formation of a tube and that this tube, normally by metering, is filled with the intended contents and that the filled section of the tube is sealed off and separated from the remaining parts of the tube. The inconvenience inherent in this procedure is that it is necessary to work with very wide webs of material and that the process is not entirely hygienic, since that side of the plastic foil web which is to form the inside of the package is exposed to its ambient surroundings. Another known method is to operate using two separate pre-printed plastic foil webs which are reeled off from two separate magazine reels and are united with one another along their longitudinal edge zones for the formation of a tube of elongate and slim cross-section. The tube is filled and the packages are separated in known manner. The drawback inherent in this procedure is that the printed web face in the magazine reel will lie in contact with that side of the packaging material web which is intended to form the inside of the package. Such lengthy contact entails that flavour and aroma substances migrate from the printing ink to the web surface forming the inside of the package, which entails that the contents packed in the package will be tainted by taste and aroma from the printing ink. Another method is to roll up, on one and the same magazine reel, two separate webs pre-printed with information and advertising text, these webs being jointly unreeled and edge-sealed. The drawback inherent in producing bag packs from two separate webs which are unreeled from the same magazine reel is that it is difficult to adapt the printed text or decor on the webs to one another, for which reason a displacement easily occurs between the webs. This inconvenience may naturally be remedied by employing two separate webs which are unwound in a controlled and regulated manner from two separate magazine reels, this not, however, being desirable because of the previously recounted risks of taste tainting, as well as for operational reasons since the machine operator must then supervise two separate reel holders with consequential double reel change, and this method requires advanced regulation and control equipment in order that the webs be united in register with one another.

In yet a further prior art method, a tube or hose of plastic foil is produced in that a molten plastic material is forced under pressure through an annular extruder nozzle, and in that the thus formed tube or hose is expanded with the aid of gas introduced into the hose at slightly higher pressure than the pressure acting on the outside of the hose.

A method of this type is disclosed in GB, A, 670313. In this method, the extruded hose which, if necessary, may be divided into a plurality of part webs, is flattened. However, on being flattened out, the extruded tube or hose is not disposed to cause the insides of the hose to adhere to one another, for which reason bacteria-contaminated air cannot be prevented from penetrating in between the above-mentioned insides. After production of the finished bag, a sterilisation treatment of the contents of the bag is therefore necessary.

A method of this latter type is also disclosed in GB, A, 1527065. In the method described in this publication, the material web is divided up into two part webs, only one side of the part web being longitudinally sealed in connection with the filing of contents. Nor in this case are the insides of the two part webs caused to adhere to one another in connection with rolling onto the magazine reel. A similar method without division of the material web into part webs is disclosed in FR, A, 1251602.

U.S. Pat. No. 4,997,616 and EP, A, 392690 show methods of producing a tube or hose of plastic foil in that a molten plastic material is forced under pressure through an annular extruder nozzle, whereafter the thus formed tube or hose is expanded with the aid of a gas introduced into the hose at slightly higher pressure than the pressure acting on the outside of the hose.

OBJECT OF THE INVENTION

The object of the present invention is to make possible the production of bag packs from extruded, wide plastic foils in which the sides of the plastic foil webs forming the insides are hygienically treated and are disposed to prevent the penetration of bacteria-contaminated air between these sides, the inside-forming faces, on being unreeled from one and the same magazine reel, not lying in contact with printed material faces, and in which it is ensured that text and decor on both of the webs are not mutually displaced on unfeeling from the magazine reel.

SOLUTION

This object has been attained in that the present invention has been given the characterising features as set forth in the appended Claims.

BRIEF DESCRIPTION OF THE ACCOMPANYING DRAWING

One preferred embodiment of the present invention will now be described in greater detail hereinbelow, with particular reference to the accompanying schematic Drawing, in which.

DESCRIPTION OF PREFERRED EMBODIMENT

Figure 1:
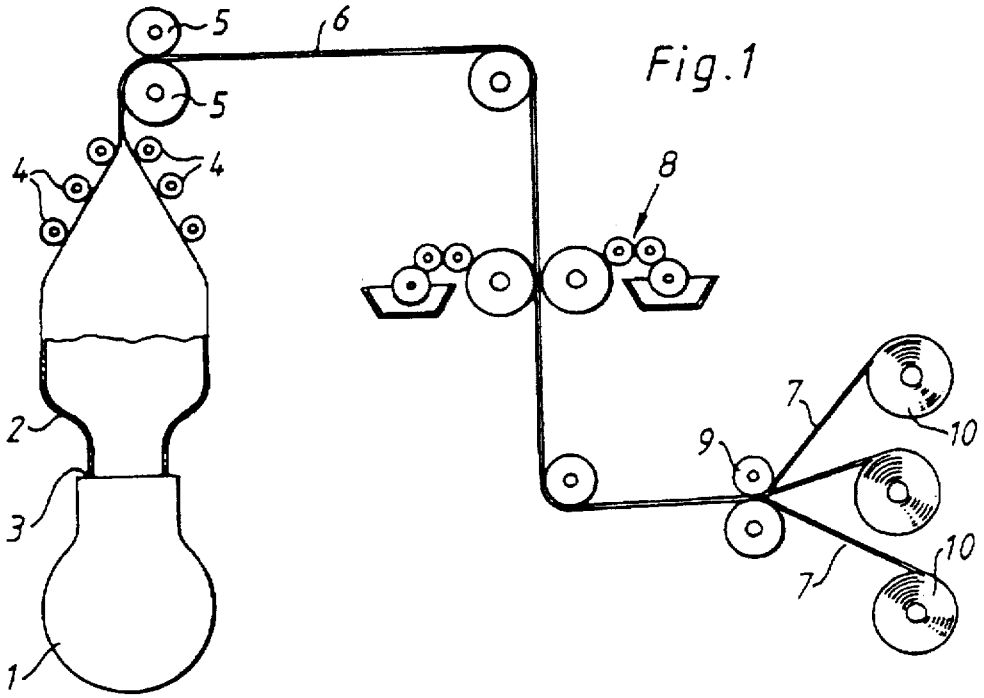
FIG. 1 shows the production of the packaging material.

As is apparent from FIG. 1, a tubular thermoplastic film 2 is produced in that a thermoplastic material e.g. polyethylene or polypropylene is, after heating to plasticity by means of so-called extruder 1, forced out through an annular nozzle 3 associated with the extruder 1, the discharge gap of the nozzle 3 determining the wall thickness of the tubular film or hose 2. The hose 2 is expanded and attenuated immediately after being forcibly extruded from the nozzle 3, in that a slight excess pressure is maintained within the hose 2, which distends the diameter of the still plastic hose 2. The hose 2 is cooled and stabilised relatively quickly after the plastic material has been forced out from the extruder 1, and this cooling process may be accelerated and controlled with the aid of air currents at the appropriately adapted temperature being aimed towards the surface of the hose 2.

The hose 2 is inserted between converging roller beds 4 by means of which the hose 2 is flattened in order finally to be compressed between cooperating roller pairs 5. In the present case, the cooling of the hose 2 is adapted so that its inside is not wholly stabilised when the hose 2 is compressed between the nip rollers 5, which entails that the inside portions of the hose 2 which are pressed towards one another and which have not been directly exposed to the cooling air currents, will adhere to one another without in actual fact being sealed to one another by material fusion. Such adhesion is usually designated "blocking" and it is typical for the blocking phenomenon that the blocking union may readily be broken without the blocked surfaces being damaged or undergoing substantial structural alteration. Before being broken however, the blocking union is so tight that bacteria-contaminated air cannot penetrate in between the blocked surfaces and, since this blocking occurred after the material had been heated to melting point in connection with extrusion, the blocked surfaces are, prior to rupture of the block, practically sterile, or, at any rate have been hygienically treated.

The hose 2 which has been flattened by compression and by blocking of the inside surfaces now forms a web 6 of double coated plastic material, the web 6 being cut into a plurality of part webs in that the edge portions of the flattened web 6 are cut off and the parts of the web 6 lying between the edge portions are cut in their longitudinal direction into part webs 7 by means of incisions through the web 6.

Before the cutting process (but optionally also after it), the web 6 or part webs 7 may be printed with cover ink, pictures or text along both sides. This printing operation is carried out, in the illustrated embodiment, by means of the printing mechanism 8 on the "wide" web 6, i.e. before the web 6 is cut, and the web 6 is thereafter severed into part webs 7 by means of the rotary knives 9 and is rolled up on separate magazine reels 10.

Figure 2:
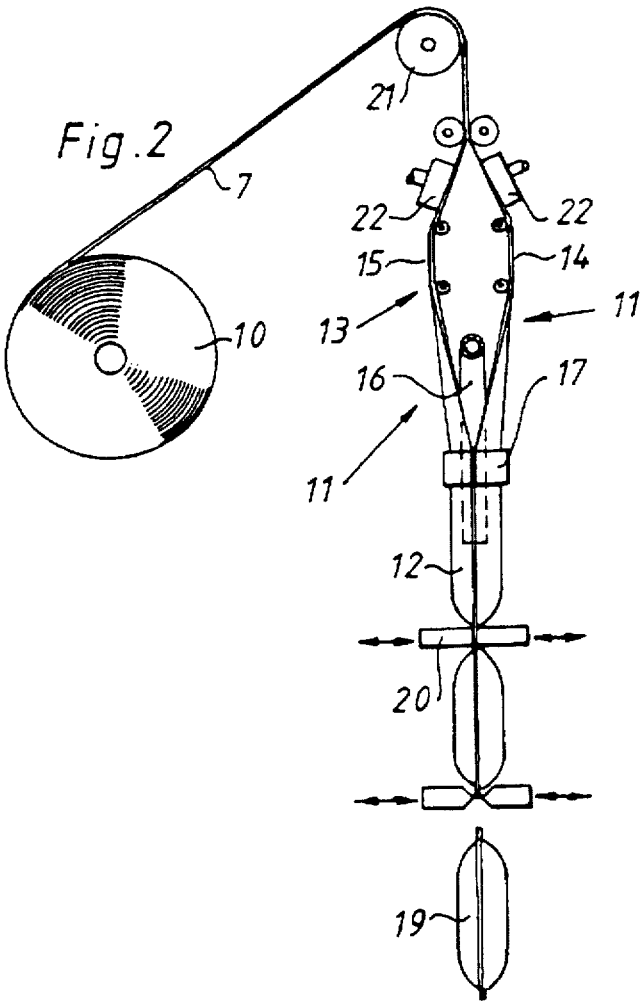
FIG. 2 shows the production and filling of the bag packs.

FIG. 2 shows how the packaging material in one magazine reel 10 can be connected to a packing and filling machine 11 which, in the described case, is of the type which converts one or more packaging material webs into a tube 12 in that the longitudinal edges of the web or webs 7 are united with one another, whereafter the tube 12 is filled with the intended contents, sealed and divided into individual package units.

In the illustrated specific case, the two mutually adhering layers of the web 6 are first separated by means of a separator device 13 which, for example, may consist of suction plates 22 or suction cups acting on the outside of the web 6, and/or of fingers which are guided in between the blocked layers 14 and 15 of the web 6, or by other similar devices or apparatuses suitable for separating the two layers 14 and 15 of the web 6.

Once the separate layers 14 and 15 of the web 6 have been separated from one another, a filler pipe 16 is inserted between the two separated layers or webs 14 and 15, whereafter these webs (14 and 15) are sealed to one another by means of sealing devices 17 along their free edge zones for the formation of a tube 12 in which the filler pipe 16 is inserted.

Figure 3:
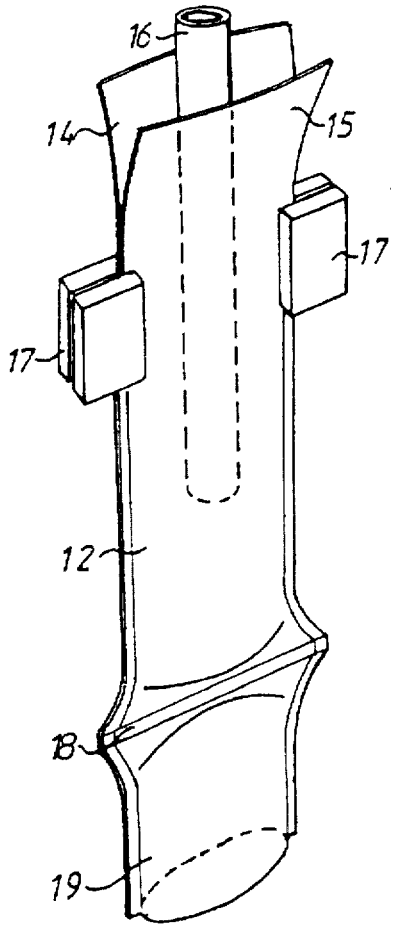
FIG. 3 shows how the tube is filled with its contents.

A separate sketch of the filling procedure is shown in FIG. 3 where the separated layers or web 14 and 15 are united with one another for the formation of a tube 12, in that their edge zones are united with one another by means of the sealing devices 17. Ahead of the sealing devices 17 (in the direction of transport) a filler pipe 16 is inserted in between the webs 14 and 15, by means of which filler pipe the intended contents are fed, by metering or continuous filling, into the formed tube 12, the tube being thereafter flattened and sealed along sealing zones 18 for the formation of separate packaging containers 19.

The layers or part webs 14 and 15 may, as illustrated in FIG. 2, be reunited after the separation process without, to this end, new blocking taking place, and, as is shown in FIG. 2, the separated webs 14 and 15 may be passed over a common bending roller 21. Once the webs 14 and 15 have been passed over the bending roller 21 and directed substantially downwards, the filler pipe 16 inserted between the part webs, whereafter the web edges of the webs 14 and 15 are sealed to one another by means of the sealing devices 17. As shown in FIG. 2, the thus formed tube 12 is divided by means of sealing devices 20 into individual packaging containers 19 once the tube 12 has been severed by means of incisions in the thus formed sealing zones.

The method according to the present invention has proved to be very simple to reduce into practice and gives a good standard of hygiene. The equipment which is required for manufacturing bag packs according to the invention will be economical, operationally reliable and uncomplicated to operate. Fundamentally, the production of the material resides in known technology but some experience, professional skills and control equipment are required in order to obtain a controlled blocking between the inside layers of the flattened, extruded plastic tube.

The present invention should not be considered as restricted to that described above and shown on the Drawing, many modifications being conceivable without departing from the spirit and scope of the appended Claims.

What is claimed is:

1. A method of producing bag packs of plastic foil containing liquid or viscous contents, a hose of plastic foil being produced in that a molten plastic material is forced under pressure through an annular extruder nozzle and the thus formed tube or hose is widened in extent with the aid of a gas introduced into the hose at slightly higher pressure than the pressure acting on the outside of the hose, characterized in that a) the extruded hose is, while the plastic material is still warm and not fully stabilized, flattened and compressed in the flattened state, mutually compressed parts of the inside of the hose being caused to adhere to one another without being sealed to one another by surface fusion;

b) the flattened and internally adhering hose is cut along longitudinal section lines, for the formation of part webs of a smaller width adapted for said bag packs, said part webs each displaying upper and lower plastic foils adhering to one another, and said part webs being capable of being wound up onto magazine reels;

c) the flattened hose is, either before or after said cutting, printed on both sides with covering ink and/or with decor or text;

d) the plastic foils in said part webs are separated from one another, in that the adhesive force between the plastic foils is overcome, whereafter the longitudinal edges of the plastic foils are sealed to one another by surface fusion of the plastic material in the sealing region, for the formation of a tube; and e) said tube is filled through a filling pipe with its intended liquid or viscous contents, whereafter the tube is divided into individual bag packs by repeated transverse seals at right angles to the longitudinal direction of the tube, and that the through-going incisions of the plastic foils are provided in said transverse sealing zones.

2. An apparatus for carrying out the method according to claim 1, comprising an extrusion device for producing a hose of plastic foil in that a molten plastic material is forced out under pressure through an annular extruder nozzle and the thus formed hose is widened in extent with the aid of a gas introduced into the hose at slightly higher pressure than the pressure acting on the outside of the hose, characterized by structure for flattening and surface cooling of the extruded hose and for compressing the flattened hose so that its inner sides are brought into contact with one another and are brought into a releasable adhesion by blocking without surface fusion, a device for cutting the flattened and interiorly adhering hose along longitudinal section lines, for the formation of part webs of a width adapted to said bag packs, said part webs each displaying upper and lower plastic foils adhering to one another, said part webs being intended to be rolled up on magazine reels, a device for printing, either before or after said cutting operation, the flattened hose with covering ink and/or with decor or text, a device for separating the plastic foils of the part webs from one another, in that the adhesive force between the plastic foils is overcome, a device for sealing the longitudinal edges of the plastic foils to one another, for the formation of a tube, a filling tube for filling the thus formed tube with liquid or viscous, and a device disposed to form, by repeated transverse sealing transversely of the filled tube, separate bag-like packages.

3. A method of producing bag packs of plastic foil containing liquid or viscous contents, said method comprising:

producing a heated extruded hose of plastic foil by forcing a molten plastic material under pressure through an annular extruder nozzle;

widening said hose of plastic foil by introducing a gas into the hose at a pressure slightly higher than a pressure acting on the outside of said hose;

flattening and compressing said heated extruded hose while said plastic foil is still warm and not fully stabilized such that mutually compressed parts of the inside of the hose are caused to adhere to one another by blocking without being sealed to one another by surface fusion;

printing on at least one side of said flattened hose;

cutting through the flattened, compressed, and internally adhering hose along longitudinal section lines to form at least one part web of a width corresponding to said bag packs, said part webs each displaying upper and lower plastic foils adhering to one another, and said part webs being capable of being wound up onto magazine reels;

separating the plastic foils in said part webs from one another by overcoming the adhesive force between the plastic foils;

sealing the longitudinal edges of the plastic foils to one another by surface fusion of the plastic material in a sealing region to form a tube;

filling said tube with its intended contents; and dividing said tube into individual bag packs by repeated transverse seals at right angles to the longitudinal direction of said tube.

* * * * *